US006477879B1

(12) United States Patent
Sawa

(10) Patent No.: US 6,477,879 B1
(45) Date of Patent: Nov. 12, 2002

(54) METHOD AND APPARATUS FOR ROLLER TYPE PROCESSING

(75) Inventor: Masazumi Sawa, Nagoya (JP)

(73) Assignee: Tri Engineering Company Limited (JP)

( * ) Notice: Subject to any disclaimer, the term of this patent is extended or adjusted under 35 U.S.C. 154(b) by 0 days.

(21) Appl. No.: 09/530,974

(22) PCT Filed: Sep. 3, 1999

(86) PCT No.: PCT/JP99/04812

§ 371 (c)(1),
(2), (4) Date: May 5, 2000

(87) PCT Pub. No.: WO00/13816

PCT Pub. Date: Mar. 16, 2000

(30) Foreign Application Priority Data

Sep. 8, 1998 (JP) ..... 10-253972

(51) Int. Cl.[7] ..... B21D 39/02
(52) U.S. Cl. ..... 72/220; 72/701; 29/243.58
(58) Field of Search ..... 72/210, 214, 215, 72/220, 207, 701; 29/243.58; 413/6

(56) References Cited

U.S. PATENT DOCUMENTS

| | | | | |
|---|---|---|---|---|
| 1,818,227 A | * | 8/1931 | Livensparger | 72/701 |
| 4,574,607 A | * | 3/1986 | Akino et al. | 72/207 |
| 4,802,355 A | | 2/1989 | Ezell | |
| 5,224,253 A | * | 7/1993 | Sawa | 72/220 |
| 6,161,410 A | * | 12/2000 | Shook et al. | 72/220 |

FOREIGN PATENT DOCUMENTS

| | | | | |
|---|---|---|---|---|
| JP | 61-122033 | | 8/1986 | |
| JP | 02006022 | | 1/1990 | |
| JP | 2-70325 | * | 3/1990 | 72/220 |
| JP | 02112833 | | 4/1990 | |
| JP | 04253524 A | | 9/1992 | |
| JP | 10180373 A | | 7/1998 | |

OTHER PUBLICATIONS

Office Action from the Japanese Patent Office mailed Jul. 6, 1999 and an English translation thereof for Patent Application No. 10–253972 (4 pages).
International Search Report (PCT/JP99/04812).

* cited by examiner

*Primary Examiner*—Lowell A. Larson
(74) *Attorney, Agent, or Firm*—Patterson, Thuente, Skaar & Christensen

(57) ABSTRACT

In a prior art roller type processing apparatus for processing a workpiece by roll pressing a roller, the roller is roll-pressed at the same location a number of times. Thus, longer processing time is required compared to processing using pressing dies. It is, accordingly, an object of the present invention to reduce the processing time by providing a roller type processing apparatus. Therefore, in the present invention, rollers 13, 14 are attached to a plurality of independently controllable robot arms 11, 12, respectively, and the rollers 13, 14 are successively roll-pressed along a portion to be processed We of a workpiece W in different rolling positions.

29 Claims, 10 Drawing Sheets

METHOD AND APPARATUS FOR ROLLER TYPE PROCESSING

This application is a national stage filing under 35 U.S.C. § 371 of International Application No. PCT/JP99/04812, filed Sep. 3, 1999, which claims priority to Japanese Patent Application 10-253972, filed Sep. 8, 1998.

FIELD OF THE INVENTION

The present invention relates to methods and apparatus for roller type processing, which are suitably used for hemming a peripheral edge, e.g. a door panel, hood panel or the like for a vehicle, or for general bending processes.

BACKGROUND OF THE INVENTION

As shown in FIG. 18, the applicant has proposed a roller type processing apparatus M for processing a portion We to be processed by roll-pressing a roller r0 along the peripheral edge of the portion We of a workpiece W (as disclosed in Japanese Patent No. 1844282).

This roller type processing apparatus M has a robot arm R to which a roller is attached and which can be moved according to a predetermined operating program, which permits the roller r0 to be roll-pressed along a desired travelling path. As a result, smooth processing along a curved contour can be achieved. Thus, the apparatus M can be suitably used, in particular to hem a workpiece, such as a door panel or an engine hood panel of a vehicle.

Further, the travelling path of the robot arm R can be changed by changing the operating program of the robot arm R, thus generally providing greater versatility compared to conventional processing using pressing dies.

DISCLOSURE OF THE INVENTION

However, the above prior art apparatus M was found to have some disadvantages. As a specific example, for this hemming process, it is difficult to completely bend the workpiece portion We in one pass using the roller r0. Therefore, according to the prior art, the workpiece portion We is first bent by about 45° with the roller r0 being held in a position tilted by about 45° (a pre-bending process or an intermediate bending process). Thereafter, the position of the roller r0 is shifted to a horizontal position. The roller r0 held in the horizontal position is again roll-pressed along the portion We that has been subjected to the pre-bending process, so as to completely bend the portion We (a main bending process or a final bending process).

If the portion to be processed has a large width, it is necessary to repeat the above-mentioned intermediate process two or more times.

As described above, according to the prior art, it is necessary to gradually process the portion We by roll-pressing the roller r0 against the portion We a number of times. Such a process takes a longer time compared to processes that use pressing dies (a pressing process using an upper die and a lower die).

It is, accordingly, an object of the present invention to provide methods and apparatus for roller type processing, which can reduce processing time and improve processing quality.

According to a preferred embodiment of the invention, a plurality of rollers are successively roll-pressed or in a close positional arrangement with respect to each other. Therefore, the workpiece can be gradually bent by the plurality of rollers in one pass. Thus, processing time can be significantly reduced. Further, the robot arms are controlled independently of each other, so that the rollers can be roll-pressed independently of each other without being affected by each other. Therefore, the rollers can be roll-pressed independently of each other even along a curved contour. Thus, this feature of the prior art roller type processing apparatus (i.e. processing along a desired contour) is not impaired.

The term"continuously roll-pressing the rollers" means that roll-pressing of one roller on the forward side in the rolling direction is followed by roll-pressing of another roller on the rear side in the rolling direction. In other words, a plurality of rollers are arranged in a line in the rolling direction (along linear and curved travelling paths) and are roll-pressed.

Further, during a process for bending an edge of a workpiece, in particular along a curved contour, a drawing process or extending process is locally performed, in addition to a so-called bending process. Therefore, in this specification, "processing" or "process" generally means a bending process, but it also includes drawing and extending processes that are performed when bending along a curved contour.

Further, the plurality of rollers are roll-pressed in rolling positions different from each other. Therefore, a pre-bending process and a main bending process (two kinds of processing), which for example are performed in a hemming operation, can be simultaneously performed. Thus, this kind of processing can be efficiently performed. In this respect, useful effects can be obtained that cannot be obtained by a processing apparatus in which a plurality of rollers are roll-pressed in the same positions, as disclosed in Japanese Patent No. 2579530, Japanese Laid-Open Utility Model Publication No. 61-122023 and Japanese Laid-Open Patent Publication No.2-112833.

The term"rollers having different rolling positions" means the state in which the orientation of each rotation axis of the plurality of rollers is different from each other.

In recent years, plates that are thinner than conventional plates have been increasingly used as the hemming material in hemming operations, in which the above-described processing apparatus and processing method are particularly suited. Conventionally, steel plates having a thickness of 0.8 mm to 0.7 mm have been typically used, but in recent years, considering vehicle safety and conservation of global resources, the trend in material thickness is to reduce the thickness by about 10 to 20%; thus, steel plates having a thickness of 0.65 mm to 0.6 mm are now typically used.

The reduction of the plate thickness has made it extremely difficult to obtain excellent results using the hemming operation. For thinner plates, deficiencies frequently occur, such as distortion or waving of the surface that has been processed, or waving of a flange portion. Therefore, it is extremely difficult to select processing conditions that can reduce or eliminate such deficiencies. For example, hemming devices as disclosed in Japanese Patent No. 2579530 and seaming devices as disclosed in Japanese Laid-Open Utility Model Publication No. 61-122023 and Japanese Laid-Open Patent Publication No.2-112833 can not achieve high-quality processing of materials having a complicated contour or reduction of processing time, both of which are required to hem such thinner plates. Specifically, the use of a plurality of robot arms as disclosed in the above publications only serves to widen the area that can be processed. Further, high-quality processing of a complicated contour cannot be performed by only continuously roll-pressing the rollers.

A preferred embodiment of the present invention can satisfy such high requirements, especially for hemming operations, such as complicated and high-quality processing and reduction of processing time, while improving productivity at the same time. Because the roller type processing apparatus and method according to the present invention have a plurality of rollers attached to a plurality of independently controllable robot arms, which are successively roll-pressed in respective rolling positions that are different from each other, the angular position, location and arrangement of each of the rollers can be set as desired.

According to another preferred embodiment of the present invention, before spring back occurs in a portion that has been processed by a preceding roller, a subsequent roller again processes the portion. Therefore, when processing, it is not necessary to compensate for spring back and processing can be achieved without distortions.

According to another preferred embodiment of the present invention, when the portion to be processed has a large width, one roller is roll-pressed along the proximal end of the portion, while the other roller is roll-pressed along the edge end of the portion. As a result, the wider portion to be processed can be processed in fewer cycles compared with the prior art.

According to another preferred embodiment of the present invention, the wider portion to be processed can be processed with higher accuracy in fewer cycles.

According to another preferred embodiment of the present invention, the rollers and the workpiece are simultaneously moved. Therefore, the rollers need not be moved from end to end of the portion to be processed. As a result, the actual working time of the robot arms and thus the processing time can be reduced.

Further, the workpiece portion to be processed positively moves toward the rollers. Therefore, parts of the workpiece portion to be processed that cannot be accessed purely by the movement of the robot arms (the movement of the rollers) can be also processed. Thus, the area that can be processed by the processing apparatus can be increased.

BEST MODES FOR CARRYING OUT THE INVENTION

Figure 1:
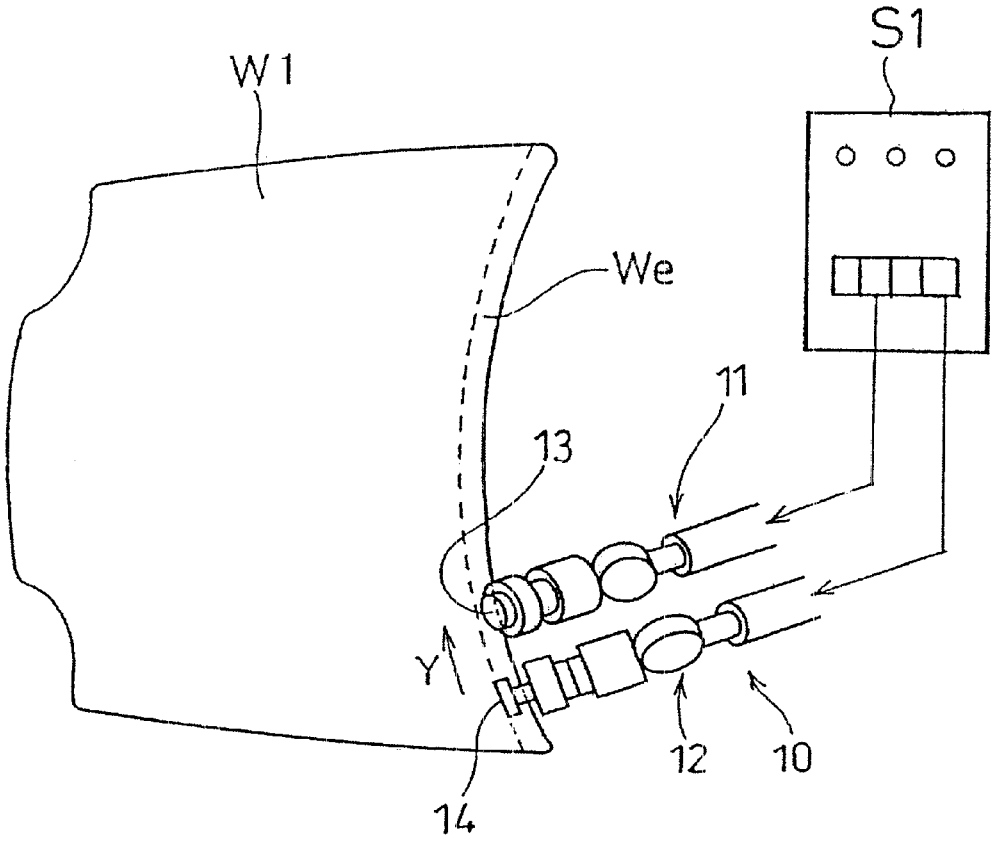
FIG. 1 is a plan view showing a first embodiment of the invention, in which a pre-bending roller and a main bending roller are press-rolled against a vehicle engine hood panel as a workpiece.

A first embodiment of the present invention will now be explained with reference to FIGS. 1 to 10. In the first described embodiment, a hemming process is performed on a vehicle engine hood (a workpiece W1) having an inner panel Q and an outer panel P. Specifically, a roller type processing apparatus 10 (hereinafter "a processing apparatus") according to the first embodiment, which will now be described, is used in the hemming process, in which a peripheral edge (a portion We to be processed) of the outer panel P is folded by a certain width and a peripheral edge of the inner panel Q is inserted into the inside of the bent portion We. Thus, the outer panel P is integrally assembled with the inner panel Q using the hemming process. FIG. 1 shows the processing apparatus 10 of the first embodiment.

The processing apparatus 10 of the first embodiment has two robot arms (a first robot arm 11 and a second robot arm 12) and a controller S1 for moving the robot arms according to a predetermined path. A pre-bending roller 13 is rotatably attached to a tip of the robot arm 11 and a main bending roller 14 is rotatably attached to a tip of the robot arm 12. The rollers 13, 14 are cylindrical in this embodiment, but they may be conical or have other shapes.

Robot arms 11, 12 have been previously described for polar coordinate type multi-articulated robots. The robot arms 11, 12 are controlled independently of each other by inputting a program into the controller S1 or by physically manipulating the robot arms 11, 12. Therefore, the rollers 13, 14 can be moved along the portion We to be processed of the workpiece W1, while the respective press-rolling angles with respect to the workpiece portion We are controlled independently of each other.

Either two separate multi-articulated robot arms or a plurality of arms provided in one multi-articulated robot may be used as the two robot arms 11, 12.

Figure 4:
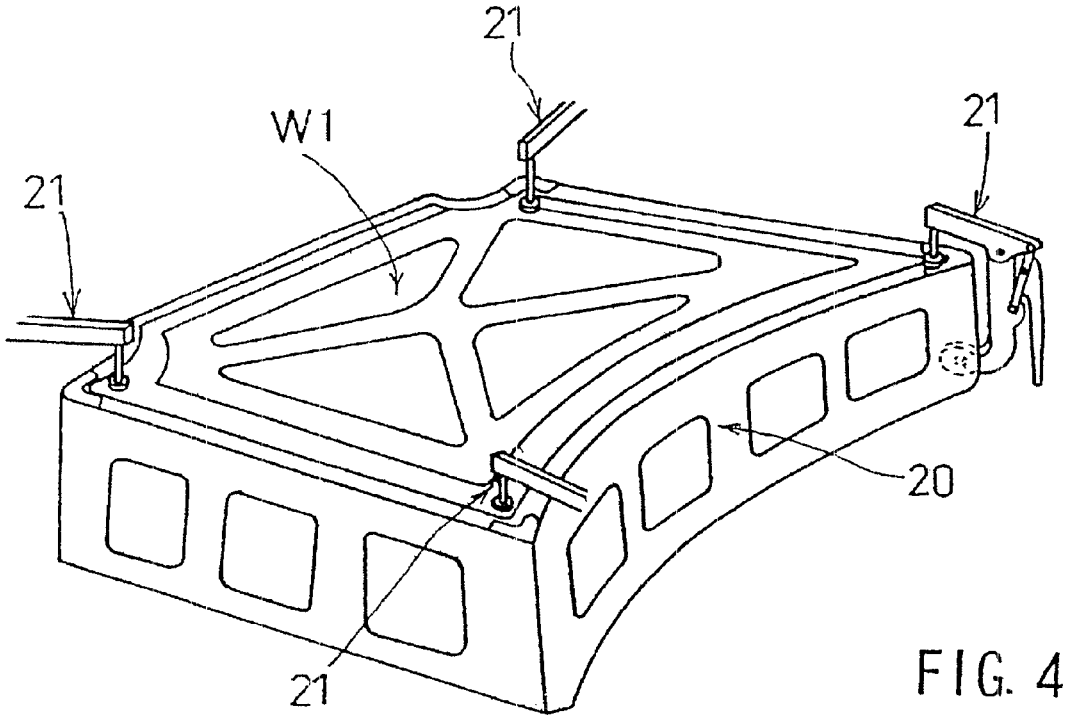
FIG. 4 is a perspective view of a fixing jig.

The workpiece W1 is positioned on and secured to a fixing jig 20 that has clamping devices 21 disposed on the four corners of the fixing jig 20, as shown in FIG. 4. Portion We of the workpiece W1 (the outer panel P) is bent substantially at right angles, as shown by a phantom line in FIG. 2 prior to the hemming operation, which will be described below.

With the processing apparatus 10 thus constructed, as shown in FIG. 1, the two robot arms 11, 12 are operated simultaneously according to the respective operating programs. The rollers 13, 14 move in the direction shown by arrow Y. At this time, the rollers 13, 14 are successively disposed along the moving direction (in a line along the moving direction) and as close as possible without interfering with each other.

Figure 2:
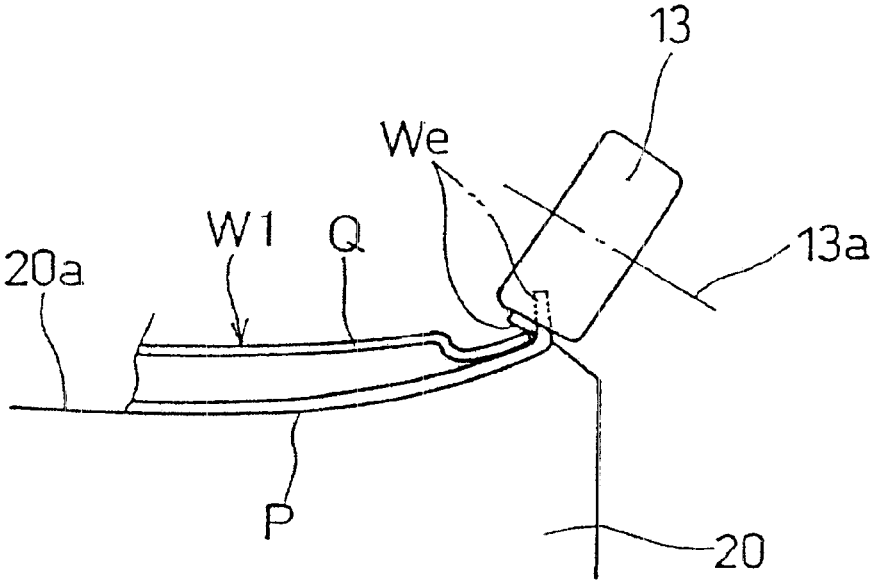
FIG. 2 is a side view of the pre-bending roller in the rolling process.

As shown in FIG. 2, the preceding pre-bending roller 13 is roll-pressed along the workpiece portion We of the outer panel P in the direction Y, while being held in a position in which the rotation axis 13*a* of the roller 13 is tilted by about 45° with respect to the workpiece mounting surface 20*a* (the upper surface as viewed in the drawing) of the fixing jig 20. Thus, the workpiece portion We is preliminarily and gradually bent by about 45°, as shown by a solid line in the drawing.

Figure 3:
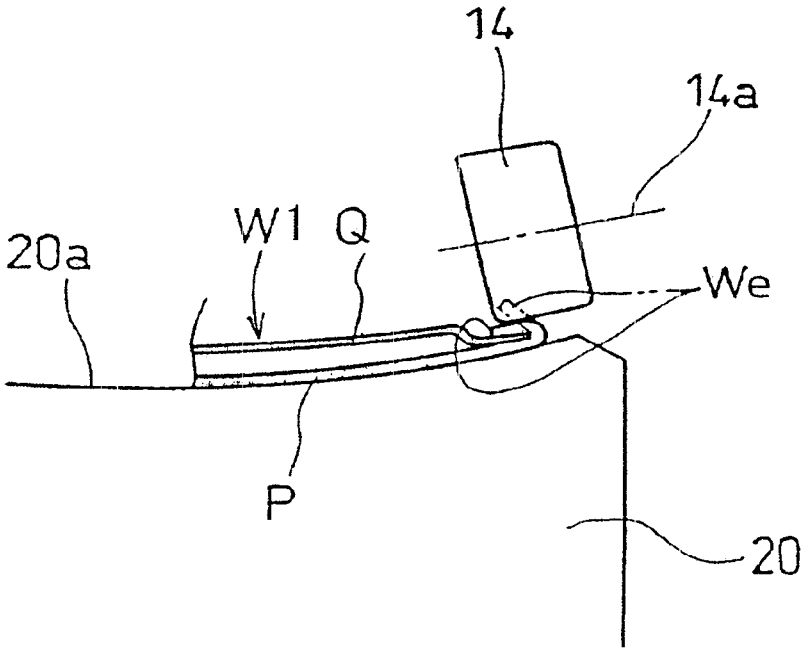
FIG. 3 is a side view of the main bending roller in the rolling process.

As shown in FIG. 3, the subsequent main bending roller 14 is roll-pressed along the workpiece portion We, which has been preliminarily bent by the preceding pre-bending roller 13, while being held in a position in which the rotation axis 14*a* of the roller 14 is substantially parallel to the workpiece mounting surface 20*a* of the fixing jig 20. Thus, the workpiece portion We, which was preliminarily bent, is substantially folded in the main bending process.

The rollers 13, 14 are precisely roll-pressed along the curved contour of the workpiece portion We as well as the linear contour by the first and second robot arms 11, 12 that are controlled independently of each other.

When the pre-bending roller 13 and the main bending roller 14 have moved from end to end of one side of the workpiece W1, the hemming operation is completed for that side. The hemming operation for the workpiece W1 is completed by repeating such a hemming operation for each side (generally four sides if the workpiece is an engine hood panel as shown).

Thus, with the processing apparatus 10 of the first embodiment, the pre-bending and the main bending operations are performed substantially at the same time. Therefore, the hemming operation is completed in one pass, that is, by roll-pressing the rollers 13, 14 only once from end to end of the portion to be hemmed of the workpiece W1. In this respect, in the prior art, in which a single roller r0 is used for pre-bending and main bending operations, it was necessary to repeat the rolling from end to end of the portion to be hemmed several times (two or more cycles). Therefore, using the processing apparatus 10 of the first embodiment, the hemming time can be greatly reduced compared to the prior art.

Figure 9:
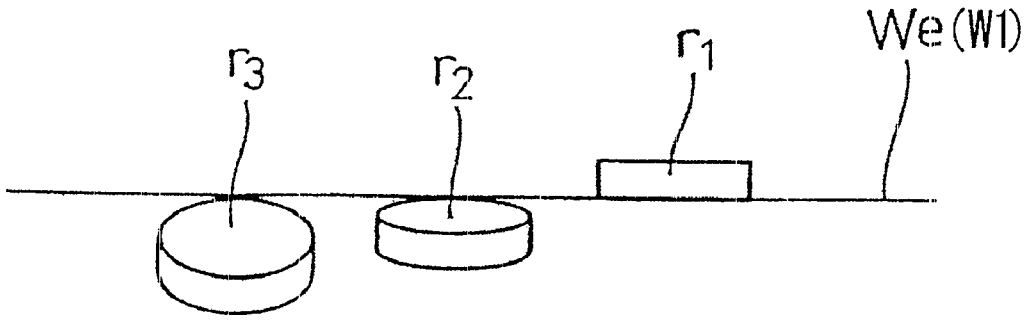
FIG. 9 is a schematic view of three rollers positioned in a line and positioned along a linear portion to be processed.
Figure 10:
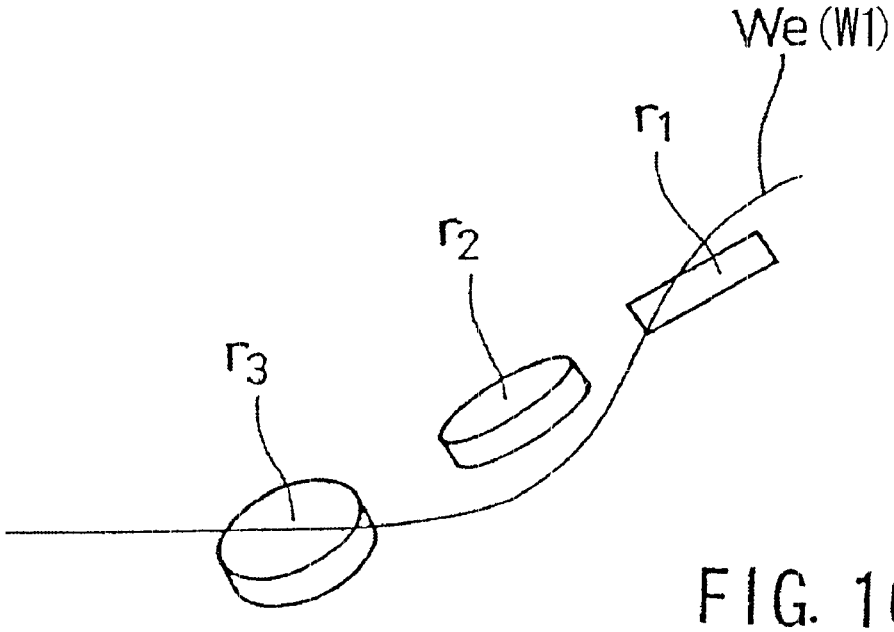
FIG. 10 is a schematic view of the three rollers positioned in a line, but showing that the rollers cannot be positioned along a curved portion to be processed.

In order to solve the above-mentioned problem with respect to the processing time, another method may be proposed in which a plurality of rollers r1, r2, r3 having different rolling positions (having rotation axes different in orientation), as shown in FIGS. 9 and 10, are attached to a single robot arm so as to permit the portion We of the workpiece W to be processed in one pass. However, if all of the rollers r1, r2, r3 move together, this method cannot be used to process a curved contour (FIG. 10), although it can be used to process a linear contour (FIG. 9). Particularly, when the workpiece W comprises a relatively thin panel having a thickness of 0.65 mm to 0.6 mm, considerable quality degradation (surface distortion or a waving phenomenon) is caused and thus, high processing quality can not be obtained as currently required.

In this respect, the processing apparatus 10 of the first embodiment also can be utilized to process a curved contour, because the rolling directions, speeds and positions of the pre-bending roller 13 and the main bending roller 14 are controlled independently of each other.

Thus, the processing apparatus 10 of the first embodiment is constructed such that the two robot arms 11, 12 are controlled independently of each other to thereby roll-press the pre-bending roller 13 and the main bending roller 14 along respective predetermined travelling paths. With such construction, unlike the construction in which the rollers r1, r2, r3 move together as described above, the rollers 13, 14 can be precisely moved along a curved contour as well as a linear contour of the workpiece portion 2*c*. Also, the processing angles (rolling angles) of the rollers 13, 14 can be changed as desired. Thus, high-quality hemming can be achieved.

Figure 5:
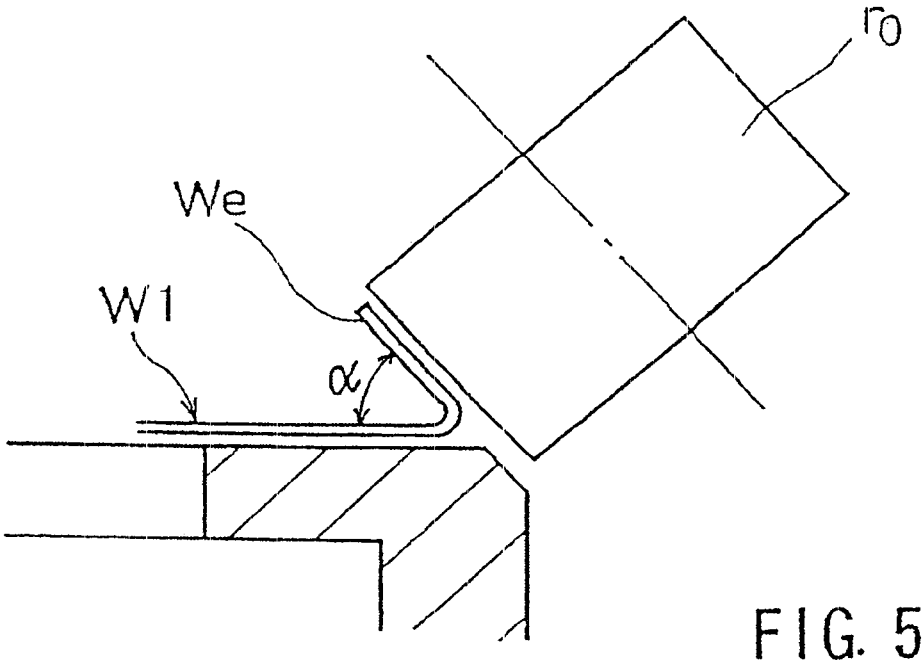
FIG. 5 is a side view showing a pre-bending state.
Figure 6:
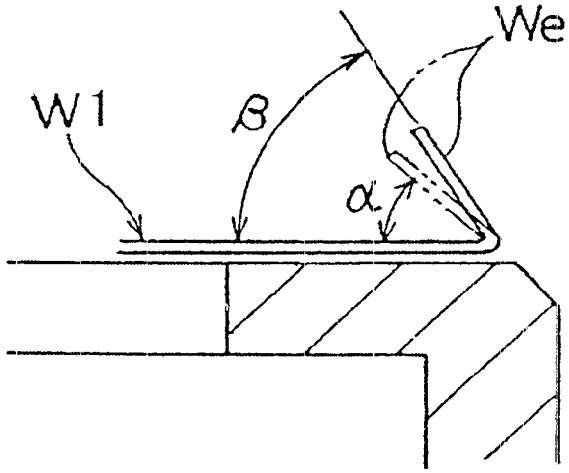
FIG. 6 is a side view showing a portion bent by the pre-bending roller and partial returned to the original position as a result of spring back.
Figure 7:
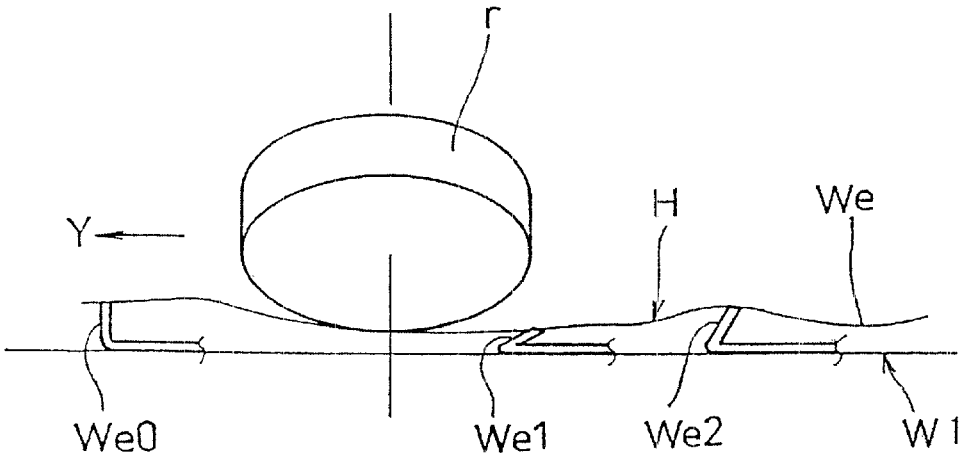
FIG. 7 is a schematic view of a prior art construction using a single roller for pre-bending, showing the state in which spring back occurs on the bent portion after the roller has passed.

When a metal panel is processed, spring back (resilient recovery) generally occurs, so that the actual processing distance is less than the theoretical processing distance. For example, if the prior art processing apparatus M is used for hemming, as shown in FIGS. 5 to 7, the workpiece portion We, which was preliminarily bent at an angle $\alpha$, returns to a position having an angle $\beta(\beta>\alpha$, FIG. 6) about 0.5 to 1.0 second after the roller r0 has passed. The amount of spring back is normally about 5 to 10°. Such spring back of about 5 to 10° in the pre-bending process significantly affects the subsequent main bending.

If allowance is made for spring back and the roller r0 is roll-pressed at an angle slightly greater than the proper pre-banding angle in order to eliminate the above-described problem, the edge end of the workpiece portion We will be elongated. In this case, as shown in FIG. 7, a wavy distortion H results in the workpiece portion We, thus causing serious quality degradation of the product. On the other hand, when the pre-bending angle is decreased, the workpiece portion We may buckle during the subsequent main bending process.

The pre-bending conditions for preventing the wavy distortion H and for preventing the workpiece portion We from buckling in the subsequent main bending process are satisfied only within an extremely limited range. Therefore, conventionally, the pre-bending process is repeated two or more times. The pre-bending is thus performed using gentler conditions. As a result, the time required for hemming is increased, so that productivity is significantly reduced.

The above problem is true not only for hemming, but also for more general processing.

Figure 8:
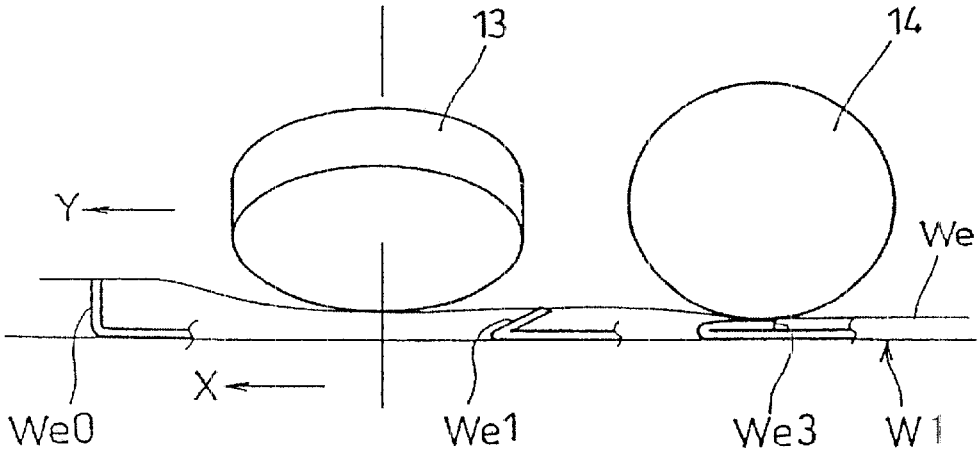
FIG. 8 is a schematic view of the first embodiment of the invention, showing the state in which the portion to be processed is bent by the main bending roller immediately after it has been bent by the pre-bending roller and before spring back occurs.

The present invention also provides an effective solution to the above problem. Specifically, as shown in FIG. 8, the pre-bending roller 13 and the main bending roller 14 are positioned as close as possible without interfering with each other, and in this state, the rollers 13, 14 are roll-pressed. In this case, the main bending is performed by the main bending roller 14 after the pre-bending process is performed by the pre-bending roller 13 and before the occurrence of spring back. Therefore, the pre-bending angle for the pre-bending roller 13 (the rolling angle of the pre-bending roller 13) can be initially set to the proper angle. As a result, the wavy distortion H in the workpiece portion We is prevented after the pre-bending process as it is when allowance is made in the pre-bending for spring back. Thus, product quality degradation is not caused.

Further, because the pre-bending is performed at the proper angle, the workpiece portion We does not buckle during the main bending process. Therefore, high-quality hemming can be efficiently performed.

Thus, it is not necessary to allow for spring back with respect to the pre-bending angle. Therefore, the pre-bending conditions tend to be gentler, which permits this processing apparatus to he readily applied to various processing modes.

Further, with the construction in which the pre-bending roller 13 and the main bending roller 14 are roll-pressed in proximity with each other, it has the effect that pressure (the force of movement in the surface direction of the workpiece that is shown by arrow X in FIG. 8) on the workpiece W1 is restrained by the main bending roller 14.

Specifically, in the prior art processing apparatus, which uses a single roller r0 for rolling, depending upon the configuration or the material of the workpiece W1, the workpiece W1 may be locally moved or locally distorted by the pressure generated by rolling the roller r0. However, with the processing apparatus 10 of the first embodiment, when the pre-bending roller 13 and the main bending roller 14 are roll-pressed in proximity with each other without interfering with each other, the workpiece W1 is pressed against the fixing jig 20 by a stronger force. As a result, frictional resistance of the workpiece W1 against the fixing jig 20 is increased. Thus, the movement of the workpiece W1 in the surface direction thereof or distortion of the workpiece W1 in the surface direction thereof is restrained. Hemming quality can be enhanced in this respect as well.

In FIGS. 7 and 8, We0 designates a portion before being bent in the pre-bending process, We1 designates a portion immediately after having been bent in the pre-bending process, We2 designates a portion having been returned toward the vertical position after the pre-bending process, and We3 designates a portion having been bent in the main bending process. Arrow Y designates the rolling direction of the rollers 13, 14.

Although the first embodiment has been described with respect to hemming an engine hood panel for a vehicle, the processing apparatus 10 according to this invention can be widely applied to a variety of other general processing techniques, such as the processing of steel plates and outer panels of airplanes. Accordingly, although in the first embodiment, the processes were referred to as"pre-bending processes" and"main bending processes", they may be replaced by the terms "intermediate bending process" and-"final bending process," which are commonly used for typical bending processes.

Figure 11:
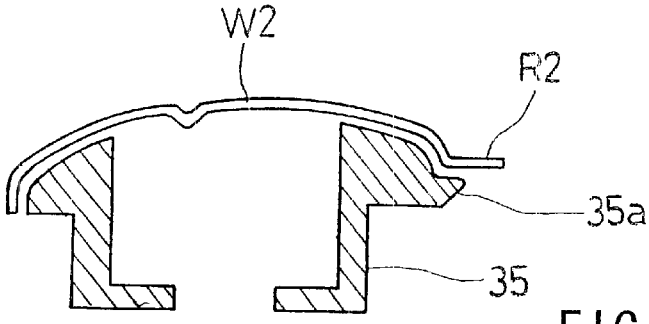
FIG. 11 is a side view of a second embodiment of the invention, showing a workpiece set on a lower die.
Figure 12:
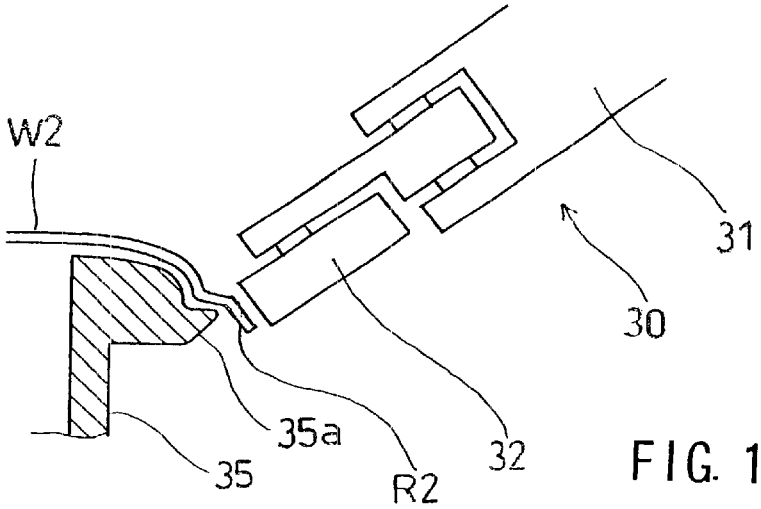
FIG. 12 is a side view of the second embodiment, showing an intermediate process.

A roller type processing apparatus 30 according to a second embodiment will now be explained, which is used for a processing of a different type from the hemming operation of the first embodiment. The processing apparatus 30 is shown in FIGS. 11 and 12. A workpiece W2 of the second embodiment is a common thin steel plate. The processing apparatus 30 processes a predetermined width along the peripheral edge of the workpiece W2. As shown in FIG. 11, the workpiece W2 is fixed on the upper surface of a lower die 35 and is arranged such that the portion R2 to be processed protrudes outwardly from a receiving portion 35*a* of the lower die 35.

As shown in FIG. 12, by the preceding movement of a robot arm 31 for the intermediate bending. an intermediate bending roller 32 is roll-pressed against the portion R2 of the workpiece W2 in an upwardly tilted position of about 45°. Thus, the workpiece portion R2 is subjected to intermediate bending over the angular range of about 45°.

Figure 13:
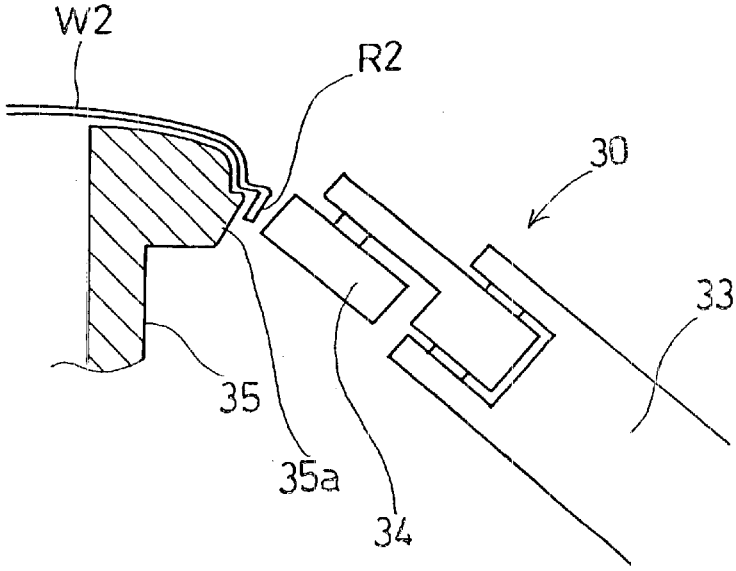
FIG. 13 is a side view of the second embodiment, showing a final process.

Simultaneously with the movement of the robot arm 31 for the intermediate bending, a robot arm 33 for the final bending moves along a predetermined travelling path. Thus, the final bending roller 34 is roll-pressed against the portion R2 that was bent by the intermediate processing of the roller 32. The final processing is shown in FIG. 13. As shown therein, the final bending roller 34 is roll-pressed against the portion R2 in a downwardly tilted position of about 45°. Thus, the workpiece portion R2 is pressed against the receiving portion 35*a* of the lower die 35, which is the final processing of the portion R2 of the workpiece W2.

Thus, also in the second embodiment, the two robot arms 31, 32 are simultaneously operated, and the two rollers 32, 34 are roll-pressed along the workpiece portion R2 in the respective rolling positions different from each other. The workpiece portion R2 is thus processed in one pass. Consequently, the same effect as the first embodiment can be achieved.

Figure 14:
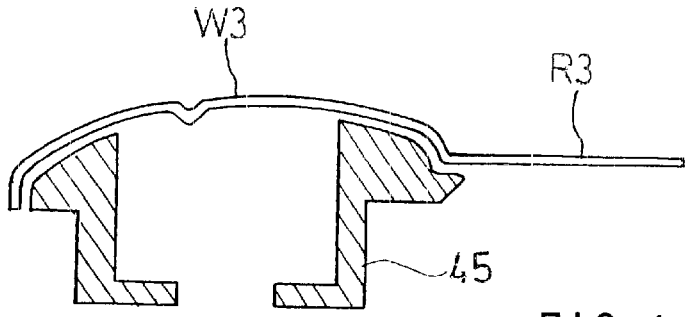
FIG. 14 is a side view of a third embodiment of the invention, showing a workpiece set on a lower die.
Figure 15:
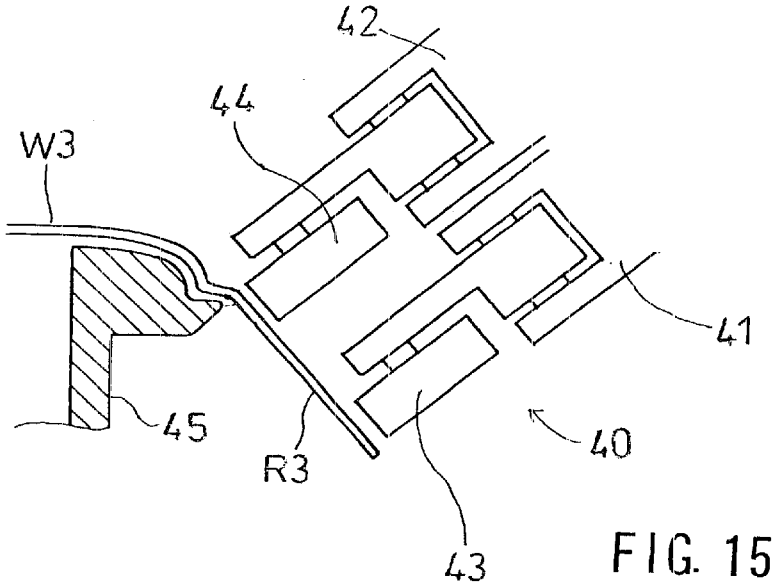
FIG. 15 is a side view of the third embodiment, showing an intermediate process.
Figure 16:
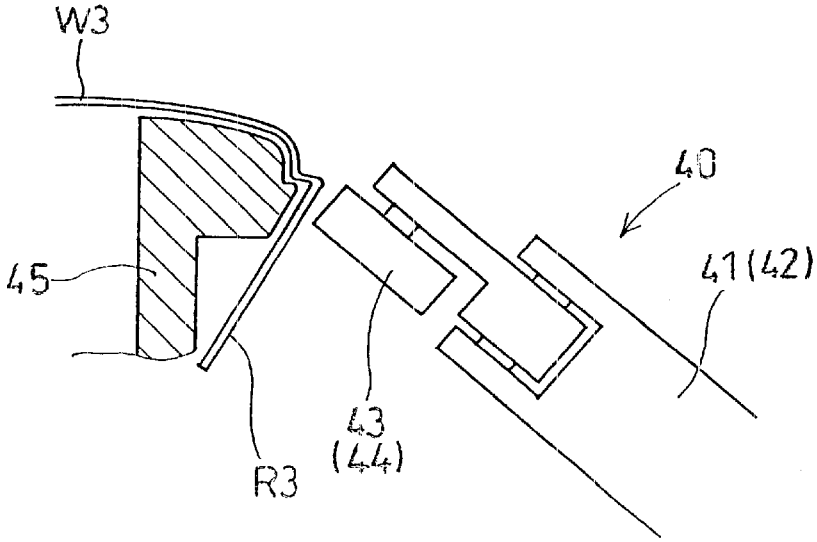
FIG. 16 is a side view of the third embodiment, showing a final process.

A roller type processing apparatus 40 according to a third embodiment is shown in FIGS. 14 to 16. A workpiece W3 to be processed by the processing apparatus 40 of the third embodiment has a portion R3 to be processed having a width larger than those of the workpieces W1,W2. The portion R3 of the workpiece W3 cannot be processed in the intermediate processing by only roll-pressing the roller along the vicinity of the proximal end as in the first and second embodiments.

Therefore, in the processing apparatus 40 of the third embodiment, two robot arms 41, 42 are positioned generally side by side during operation in the width direction of the workpiece portion R3 (in a direction perpendicular to the roller rolling direction). Specifically, the roller 44 is roll-pressed along the vicinity of the proximal end of the workpiece portion R3, while the roller 43 is roll-pressed along the edge end of the workpiece portion R3. Although it is not shown, the roller 43 on the edge end is roll-pressed slightly before the roller 44 on the proximal end. By thus rolling the edge end side with the roller 43 slightly preceding the roller 44 that is rolling the proximal end side, the workpiece portion R3 having a large width can be smoothly bent downwardly by about 45° during the intermediate processing.

As shown in FIG. 16, the workpiece portion R3, which has thus been bent in the intermediate processing, is bent in the final processing by operating one of the robot arms 41 (42) to roll-press the roller 43 (44). However, similar to the intermediate processing, the two robot arms 41, 42 also may be operated side by side in the final processing, so that the two rollers 43, 44 are roll-pressed in a side-by-side arrangement in the width direction of the workpiece portion R2.

Further, the final processing can be performed while restraining spring back by roll-pressing two rollers as described above or by successively rolling three or more rollers in the rolling direction.

As described above, even portions to be processed having a large width can be smoothly processed in one pass by roll-pressing a plurality of rollers in a side-by-side arrangement in the width direction of the portion (parallel processing). Further, when a plurality of rollers are roll-pressed continuously in the rolling direction (tandem processing) during the parallel processing, the workpiece can be processed with higher accuracy in fewer cycles.

Figure 17:
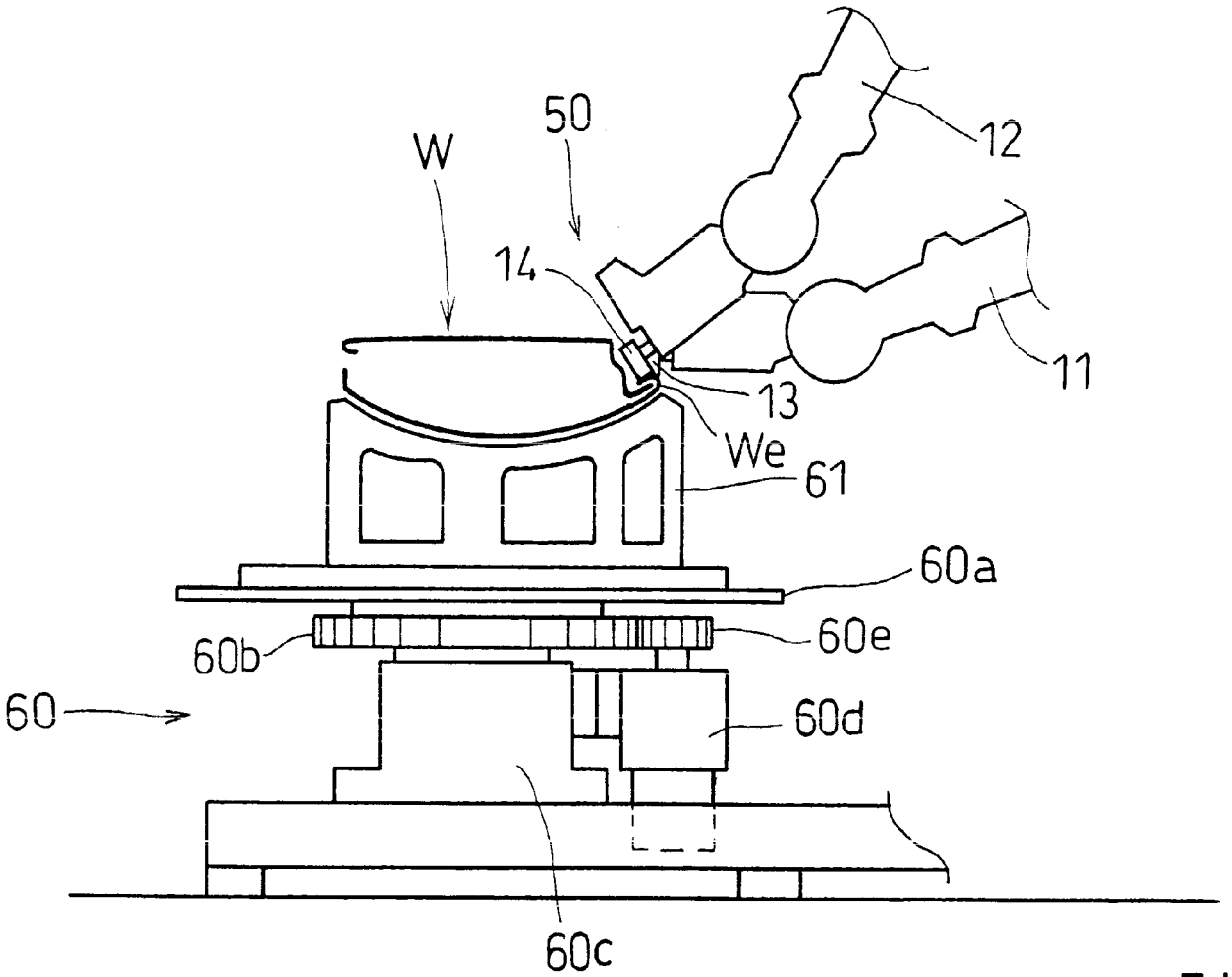
FIG. 17 is a side view of a processing apparatus according to a fourth embodiment.
Figure 18:
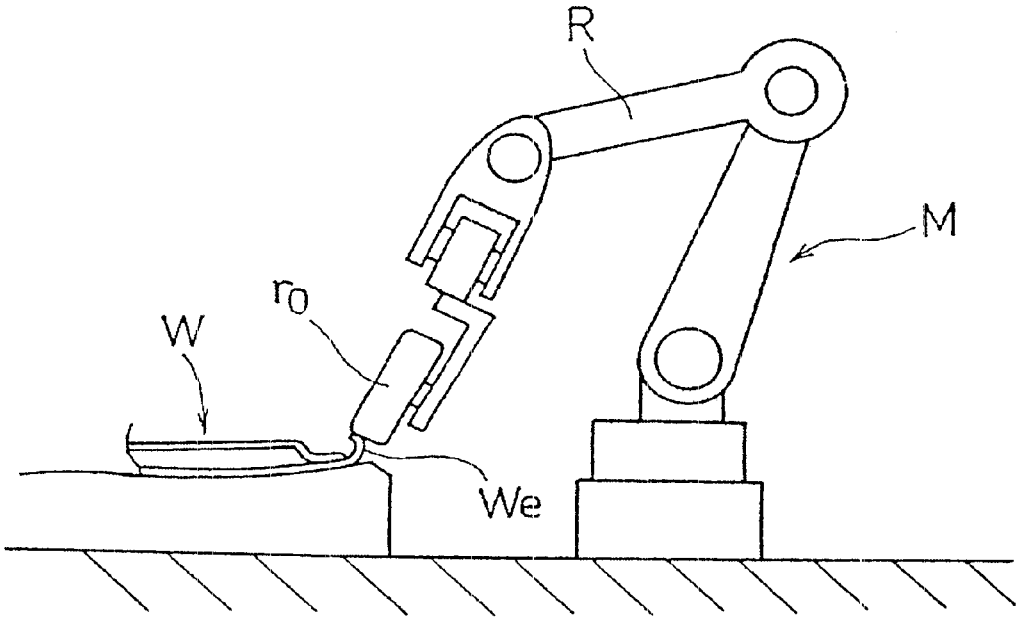
FIG. 18 PRIOR ART
FIG. 18 is a perspective view of a prior art roller type bending apparatus.

Further modifications can be made to the above embodiments. For example, as shown in FIG. 17, a roller type processing apparatus 50 according to a fourth embodiment is different from the first to third embodiments in that a fixing jig 61, which fixes a workpiece W, is rotated by a rotating device 60. The processing apparatus 50 of the fourth embodiment also has the two robot arms 11, 12 to which the pre-bending roller 13 and the main bending roller 14 are attached respectively. The rollers 13, 14 are continuously roll-pressed in the different positions along the portion We of the workpiece W.

Further, although it is not shown, a clamp device for fixing the workpiece W is provided on the periphery of the fixing jig 61. The clamp device is opened and closed in synchronization with movement of the robot arms 11, 12 so as not to interfere with the movement of the rollers 13, 14.

The rotating device 60 includes a rotary table 60*a*, a bearing 60*c* for rotatably supporting the rotary table 60*a* and a servomotor 60*d* for rotating the rotary table 60*a*. The fixing jig 61 is fixed on the rotary table 60*a*. The rotating device 60 comprises a workpiece moving means.

A pinion gear 60*e* is mounted to an output shaft of the servomotor 60*d*. The pinion gear 60*c* engages a driven gear 60*b* that is integrally mounted on the underside of the rotary table 60*a*. The servomotor 60*d* is started and stopped by the controller S1 in synchronization with the movement of the robot arms 11, 12. Then, the rotary table 60*a* rotates in a predetermined rotating direction for a predetermined number of revolutions and stops at a predetermined indexed angle. Specifically, the rotating device 60 functions as an indexing device.

In the processing apparatus 50 of the fourth embodiment thus constructed, the robot arms 11, 12 are controlled independently of each other, and the rollers 13, 14 are roll-pressed along the portion to be processed We in the different rolling positions. Thus, the portion to be processed We is preliminarily bent during the pre-bending process. Substantially at the same time, the portion We is subjected to the main bending process. Concurrently, the fixing jig 61 is rotated in a direction opposite to the rolling direction of the rollers 13, 14 by means of the rotating device 60, so that the portion We of the workpiece W is moved in a direction opposite to the rolling direction of the rollers 13, 14.

In this case, the rollers 13, 14 and the portion We of the workpiece W move simultaneously. Therefore, the rollers 13, 14 need not be moved from end to end of the portion We. Thus, the actual working time of the robot arms 11, 12 and thus the processing time can be reduced.

Further, because the portion We of the workpiece W moves toward the rollers 13, 14, the part of portion We that cannot be accessed by only movement of the robot arms 11, 12 (the movement of the rollers 13, 14) can be processed. Consequently, the wasted standby time of the robot arms 11, 12 can be eliminated and efficient processing can be performed. Further, even a large workpiece W can be efficiently processed with fewer pieces of equipment (fewer robots).

Further, because the workpiece W moves during the rolling movement of the portion We of the workpiece W from processing end to end, the distance of actual movement of the rollers 13, 14 is shorter than the distance from processing end to end of the portion We. Therefore, compared to the first to third embodiments in which the workpiece W does not move, the actual working time of the robot arms 11, 12 is reduced. Further, the relative rolling speed of the rollers 13, 14 with respect to the workpiece W is the operating speed of the robot arms 11, 12 (the absolute moving speed of the rollers 13, 14), plus the absolute moving speed of the workpiece W. Therefore, the time required for processing the portion We of the workpiece W can be reduced.

By thus simultaneously moving the portion We of the workpiece W and the rollers 13, 14 in a direction opposite to each other, the moving distance of the rollers 13, 14 can be reduced, compared with the first to third embodiments. Thus, the processing time can be reduced.

Although the servo motor 60*d* of the fourth embodiment was used to rotate the rotary table 60*a*, a hydraulic motor or the combination of a cylinder and a rack/pinion mechanism may also be used to rotate the rotary table 60*a*.

Further, although the rotating device 60 has been used as workpiece moving means for rotating the workpiece W, a linear moving mechanism (such as a linear motor, cylinder and motor together with a rack/pinion mechanism) may be used as the workpiece moving means. In this case, the rollers 13, 14 are roll-pressed while the workpiece W moves linearly.

Further, the rotating device 60 of the fourth embodiment can be applied to the case in which a wider workpiece portion We is bent by the two rollers 13, 14 arranged side by side in the width direction of the portion We (the third embodiment).

What is claimed is:

1. A roller type processing apparatus for roll-pressing a flange of a workpiece, comprising at least first and second multi-articulated type robot arms that can be controlled independently of each other, a first roller rotatably attached to the first robot arm and a second roller rotatably attached to the second robot arm, wherein the first and second rollers are closely spaced so that the second roller closely follows the first roller such that the second roller presses the workpiece flange before spring back occurs after the first roller has pressed the workpiece flange and the roll press operation of the workpiece flange is performed without causing distortion, depression or peripheral slippage of the workpiece flange, and a controller for continuously roll-pressing the first and second rollers in different rolling positions relative to each other along the workpiece flange and for roll-pressing the first and second rollers with their respective axes of rotation always maintained normal as viewed in a plane.

2. The roller type processing apparatus as defined in claim 1, wherein the first and second rollers have the same shape.

3. The roller type processing apparatus of claim 2 further comprising workpiece moving means for moving the workpiece flange in a direction opposite to the rolling direction of the rollers while roll-pressing the rollers.

4. The roller type processing apparatus of claim 1, further comprising workpiece moving means for moving the workpiece flange in a direction opposite to the rolling direction of the rollers while roll-pressing the rollers.

5. The roller type processing apparatus as defined in claim 1, wherein the first and second rollers are arranged and constructed so that the first and second rollers simultaneously roll press the workpiece with their respective axes of rotation disposed in different planes relative to each other.

6. A roller type processing apparatus, comprising a plurality of multi-articulated type robot arms that can be controlled independently of each other, a roller rotatably attached to each respective robot arm, and a controller for arranging the plurality of rollers side by side in a width direction of a portion of a workpiece being processed, wherein the controller is arranged and constructed to perform the respective roll press operations before spring back occurs in the workpiece portion being processed so that the workpiece portion being processed does not distort, depress or peripherally slip during the roll press operation, to roll-press the rollers along the workpiece portion being processed, and to roll-press the plurality of rollers with their respective axes of rotation always maintained normal as viewed in a plane.

7. The roller type processing apparatus as defined in claim 6, wherein the plurality of rollers have the same shape.

8. The roller type processing apparatus of claim 7 further comprising workpiece moving means for moving the portion being processed in a direction opposite to the rolling direction of the rollers while roll-pressing the rollers.

9. The roller type processing apparatus of claim 6 further comprising workpiece moving means for moving the portion being processed in a direction opposite to the rolling direction of the rollers while roll-pressing the rollers.

10. A roller type processing method, wherein a plurality or rollers rotatably attached to a plurality of independently controllable robot arms are continuously roll-pressed in different rolling positions along a portion of a workpiece being processed and are roll-pressed with their respective axes of rotation always maintained normal as viewed in a plane, wherein the rollers are closely disposed in a side-by-side relationship so that the respective roll press operations are performed before spring back occurs in the workpiece portion being processed and the workpiece portion being processed does not distort, depress or peripherally slip during the roll press operation.

11. An apparatus for hemming a flange of a panel, comprising:

a first hem roller having a peripheral surface adapted to press the flange of the panel;

a first robotic arm rotatably supporting the first hem roller;

a second hem roller having a peripheral surface adapted to press the flange of the panel;

a second robotic arm rotatably supporting the second hem roller;

a controller operably coupled to the first and second robotic arms and operating a stored program that independently operates the first and second robotic arms, wherein the controller causes the robotic arm to position the first hem roller at a first orientation with respect to the panel and causes the second robotic arm to position the second hem roller at a second orientation with respect to the panel, so that the first hem roller performs a preliminary bending operation on the flange and the second hem roller performs a substantially complete or final hem of the flange, and the controller causes the first hem roller to be closely disposed with respect to the second hem roller in a side-by-side relationship so as to prevent the flange from springing back after the first hem roller presses the flange and before the second hem roller presses the flange.

12. An apparatus as in claim 11, wherein the robotic arms are multi-articulated.

13. An apparatus as in claim 11, wherein the rotational axis of the first hem roller is not parallel with the rotational axis of the second hem roller.

14. An apparatus as in claim 11, wherein the first hem roller and the second hem roller are arranged and constructed to perform the preliminary and final bending operations substantially simultaneously.

15. An apparatus as in claim 10, wherein the first hem roller and the second hem roller are arranged and constructed so that the first hem roller bends a proximal end of the panel flange and the second hem roller bends an edge end of the flange.

16. An apparatus as in claim 11, further comprising means for moving the panel flange towards the rollers.

17. An apparatus as in claim 11, further comprising means for moving the panel while the panel is mounted on a fixing jig.

18. An apparatus as in claim 11, further comprising a fixing jig for supporting the panel during the hemming operation and a rotating device for rotatably supporting the fixing jig, wherein the rotating device rotates the panel in a direction opposite to the rolling direction of the rollers.

19. An apparatus as in claim 18, wherein the rotating device is arranged and constructed to move the workpiece towards the rollers.

20. An apparatus as in claim 10, further comprising a third hem roller coupled to the controller and controlled by the controller to perform an intermediate bending operation, wherein the third hem roller is disposed side-by-side and between the first and second hem rollers.

21. An apparatus as in claim 10, further comprising:

a fixing jig for supporting the panel during the hemming operation and a rotating device for rotatably supporting the fixing jig, wherein the rotating device is arranged and constructed to move the workpiece towards the rollers and to rotate the panel in a direction opposite to the rolling direction of the rollers, and a third hem roller coupled to the controller and controlled by the controller to perform an intermediate bending operation, wherein the third hem roller is disposed side-by-side and between the first and second hem rollers, wherein the robotic arms are multi-articulated, the rotational axis of the first hem roller is not parallel with the rotational axis of the second hem roller or the rotational axis of the third hem roller, the first hem roller, the second hem roller and the third hem roller are arranged and constructed so that the second hem roller closely follows the first hem roller, the third hem roller closely follows the second hem roller, such that the second and third hem rollers press the flange before spring back occurs after the first hem roller has pressed the flange.

22. A method for hemming a panel flange, comprising:

roll pressing the panel flange, thereby preliminarily bending the panel flange; and further roll pressing the portion of the panel flange that was preliminarily bent before the panel flange springs back, wherein the panel flange does not distort, depress and peripherally slip during the hemming operation.

23. A method as in claim 22, further comprising further roll pressing the panel flange that has been twice bent before the panel flange springs back, wherein the panel flange does not distort, depress or peripherally slip during the hemming operation.

24. A method as in claim 23, further comprising moving the panel flange towards the rollers during the roll pressing steps.

25. A method as in claim further comprising moving the panel during the roll pressing steps while the panel is mounted on a fixing jig.

26. An apparatus for hemming a panel flange, comprising:

means for roll pressing the panel flange, thereby preliminarily bending the panel flange, and means for further roll pressing the portion of the panel flange that was preliminarily bent before the panel flange springs back, wherein the panel flange does not distort, depress or peripherally slip during the hemming operation.

27. An apparatus as in claim 26, further comprising means for further roll pressing the panel flange that has been twice bent before the panel flange springs back, wherein the panel flange does not distort, depress or peripherally slip during the hemming operation.

28. An apparatus as in claim 27, further comprising means for moving the panel flange towards the rollers.

29. An apparatus as in claim 28, further comprising a fixing jig and means for moving the pane while the panel is mounted on the fixing jig.

* * * * *